United States Patent [19]

Auten

[11] Patent Number: 4,638,968

[45] Date of Patent: Jan. 27, 1987

[54] RUBBISH CONTAINER

[75] Inventor: Howard L. Auten, Manapapan, Fla.

[73] Assignee: Auten & Auten, Inc., Lantana, Fla.

[21] Appl. No.: 643,047

[22] Filed: Aug. 22, 1984

[51] Int. Cl.[4] ..... B65B 67/04

[52] U.S. Cl. ..... 248/97; 248/100

[58] Field of Search ..... 248/97, 100, 99, 95, 248/101; 220/404, 401

[56] References Cited

U.S. PATENT DOCUMENTS

| | | | |
|---|---|---|---|
| 434,514 | 8/1890 | Lamb | 248/97 |
| 711,410 | 10/1902 | Means | 248/97 |
| 1,356,142 | 10/1920 | Harris | 248/97 |
| 2,470,977 | 5/1949 | Chidsey | 248/97 |
| 3,633,859 | 1/1972 | Vosbikian | 248/97 |
| 4,199,122 | 4/1980 | Christie | 248/97 |
| 4,267,997 | 5/1981 | Meier | 248/97 |
| 4,469,300 | 9/1984 | Valesko | 248/97 |

FOREIGN PATENT DOCUMENTS

| | | | |
|---|---|---|---|
| 598057 | 4/1978 | Switzerland | 248/100 |
| 754064 | 8/1956 | United Kingdom | 248/95 |
| 1372491 | 10/1974 | United Kingdom | 248/99 |

*Primary Examiner*—Ramon S. Britts
*Assistant Examiner*—Karen J. Chotkowski

[57] ABSTRACT

Improved bag holding structure comprises projections protruding outwardly from bag support braces to deformably engage or perforate a bag in a first embodiment and U-shaped retaining structures in a second embodiment.

2 Claims, 12 Drawing Figures

RUBBISH CONTAINER

BACKGROUND OF THE INVENTION

1. Field of the Invention

This invention relates generally to rubbish containers and disposable plastic bags and, more particularly, to an apparatus for holding such bags in place in containers when heavy rubbish is placed inside.

2. Description of the Prior Art

Commonly, disposable plastic bags are place din rubbish containers and the tops of the bags are stretched or laid over the rim of the container to keep the mouth of the collapsible bag open to receive rubbish. When relatively heavy trash, such as damp grass, is placed into the bag, the weight exerts a considerable downward pressure on the sides and bottom of the bag. This often causes the top of the bag to slip over the rim of the container, thereby collapsing the mouth and hampering further placement of rubbish into the bag.

Previous methods of preventing such an occurrence have usually involved an element that is wrapped around the mouth of the bag after it has been placed over the rim of the container. This element, usually a band, string, rope or tape, holds the bag securely against the outside of the container to prevent the edge of the bag from being pulled back over the rim of the container by the placement of heavy trash into the bag. These methods rely on inward pressure bearing on the bag against the container rather than a pressure directly opposing the movement of the bag along the container surface. The pressure is exerted by separable devices and materials which can deteriorate or become lsot. In any event, they are often cumbersome and time consuming to install and use.

The present invention is directed to a rubbish container which will support a disposable plastic bag when heavy rubbish is placed inside. The bag is held securely by projections which deformably engage or perforate the bag, but are provided so as to resist stretching or tearing of the bag other than locally about the projections. The invention also provides for locking bag material to oppose movement of the bag.

SUMMARY OF THE INVENTION

It is an object of the present invention to provide an apparatus and method for holding disposable plastic bags securely in place inside rubbish containers when heavy rubbish is placed therein.

It is another object of the present invention to provide an apparatus and method for holding disposable plastic bags in place inside rubbish containers which requires no additional parts.

It is still another object of the present invention to provide an apparatus and method for holding disposable plastic bags securely in place inside rubbish containers where the apparatus can be easily formed using conventional techniques.

It is yet another object of the present invention to provide an apparatus and method for holding disposable plastic bags securely in place inside rubbish containers which can be used with containers having a wide variety of shapes and sizes.

These and other objects are accomplished by providing an apparatus and a quick and easy method for securing a disposable bag to a rubbish container, which requires no additional materials. The present invention provides a rubbish container having a main body portion and a rim portion wherein projections are formed at the rim portion to securably engage the top of a garbage bag. This engagement prevents the bag from collapsing into the container. The projections typically depend from the lower peripheral edge of the rim portion of the container or from recesses in the rim portion of the container.

Alternatively, the projections can be formed seaprately and fastened to the rim of a conventional container.

BRIEF DESCRIPTION OF THE DRAWINGS

There are shown in the drawings embodiments which are presently preferred. It should be understood, however, that the invention is not limited to the precise arrangements and instrumentalities shown.

DETAILED DESCRIPTION OF THE PREFERRED EMBODIMENTS

Plastic bags are manufactured in a variety of sizes as liners for rubbish containers of all shapes and dimensions. The mouth of the bag must, of course, remain open so that rubbish can easily be placed into the bag. It is a common practice to select a bag size that is somewhat larger than the containers for which it is intended and to fold the mouth of the bag over the rim of the container after the bag has been placed inside the container. This fold helps to hold the mouth open when rubbish is placed into the bag. It has now been discovered that projections located at the rim of the container and shaped and positioned so as to deformably engage or pierce a plastic bag when it is folded over the rim can greatly improve the ability of the bag-container combination to withstand the weight of heavy rubbish without the mouth of the bag collapsing back into the can.

The container can be of conventional construction and design. It usually will be constructed with plastic materials as are well known in the art, although metal or other material will do. The container may be short or tall, narrow or wide, square or round—in short, of almost any dimensions so long as a plastic bag is available which substantially covers the inside periphery of the container and which has a mouth of suitable dimension to allow it to fold over the rim of the container.

Figure 1:
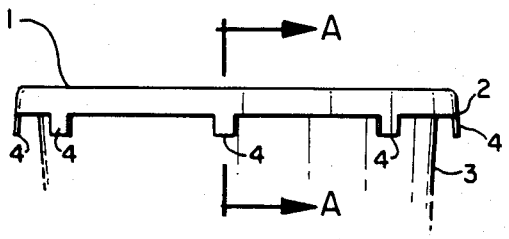
FIG. 1 is a partial elevation view of a container according to the present invention.
Figure 2A:
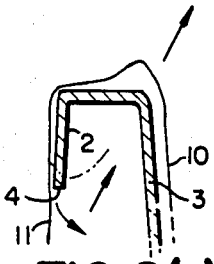
FIGS. 2(*a*) and 2(*b*) are partial section views of a container according to the present invention, taken along line A—A in FIG. 1, with a bag secured thereto.
Figure 2B:
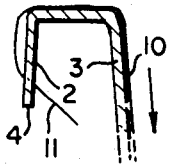

Referring now to FIG. 1, a container 1 has a main body portion 3 and a rim portion 2. The rim 2 defines a rounded or squared-off flange at the opening of the container, terminating in a downwardly-directed edge. Projections 4 depend from the lower peripheral edge of the rim portion. the manner in which the projections 4 co-act with a garbage bag to secure the garbage bag to the container will be described with reference to FIGS. 2(*a*) and 2(*b*). The bag 10 is placed into the main body portion 3 of the container and the mouth of the bag 11 is folded over the rim portion 2 of the container. A portion of the mouth of the bag 11 that is below a projection 4 is grasped in one hand while a portion of the bag above the projection 4 is grasped in the other hand. The lower hand swings the mouth of the bag 11 inwardly against and behind the projection 4 while the other hand pulls upward (FIG. 2(*a*)). The actions are preferably performed as a quick jerk. The inward and upward pulling forces the bag against the projection 4. The projection 4 locally deforms the bag as the bag is forced around it. This local deformation around the projection 4 helps to hold the bag in place when rubbish is dropped into the bag. The bag may be pierced by the projection and in this case the "buttonhole" so formed holds the bag securely in place. Further inward and upward pulling, and then a downward pull (FIG. 2(*b*)) causes the bag to "lock up." Excess bag material around the deformations or perforations is drawn upward against and behind the rim, where it provides frictional and elastic forces which tend to oppose those forces which would act to tear the bag off of the projections. The process described above is repeated for all of the projections on the container so that the bag is firmly held substantially around the entire perimeter of the mouth.

Figure 3:
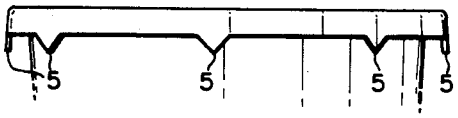
FIG. 3 is a partial elevation view of a container according to the present invention with triangular projections.

By way of example and without limitation, it has been found that the projections can be economically formed by short, possibly $\frac{1}{8}''$ or $\frac{3}{8}''$, downwardly extending rectangles. The design in FIG. 1 is a very economical one to produce because it is right at the mold parting line and existing molds could have pockets cut into their cavity side without large expense. Alternatively, the projections can be substantially triangular in shape such as the projections 5 in FIG. 3. The triangular projections 5 will usually perforate the bag when it is pulled downwardly and inwardly against them, securely locking the bag in place.

The projections need not be sharp to penetrate most bags. Better retention may result if the projections are simply pushed into the bag material, deforming it enough to secure it to the container. Perforating works well but tends to develop tears in the bag. In any event, improved holding results when the bag is pulled firmly over the top of the rim and drawn down inside of the container during the process of engaging the projections, even without complete perforation.

Figure 4:
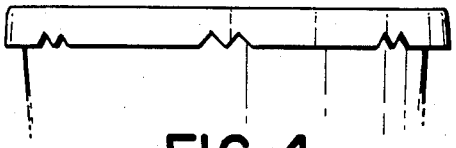
FIG. 4 is a partial elevation view of a rim container according to the present invention with recessed projections.

Projections depending beyond the rim of the container can be a nuisance as they tend to catch fingers when the container is lifted. It is therefore preferred to form the projections in recesses in the rim portion as shown in FIG. 4. The projections do not depend below the lower peripheral edge of the rim. This configuration can be especially advantageous as the bag material tends to gather both behind the projections and int he slots at the base of the projections. This gathering helps to lock the bag in place, counteracting strains caused by the weight of rubbish and preventing undue stretching and tearing. Wedge-shaped slots create more gathering effect as the bag material is worked upward and behind the projections. The recesses cause almost no weakening of the container rim's stiffness because the top horizontal part of the rim that is largely responsible for stiffness remains intact.

Figure 5:
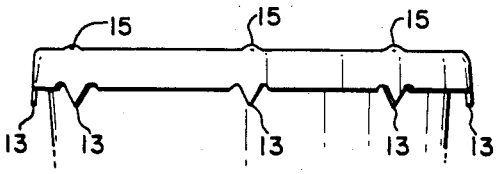
FIG. 5 is a partial elevation view of a container according to the present invention with semi-recessed projections and raised surfaces.

The engagement process must be repeated at each projection around the rim of the container. The user accordingly must find these projections even though they ahve been covered by the bag. This can be accomplished by running fingers around the periphery of the rim and thereby sensing a projection. The recessed projections may be somehwat difficult to find. To this end, a modification of the recessed projection design, such modification depicted in FIG. 5, may be desirable. The projections 13 are somewhat recessed but stille xtend beyond the edge of the rim portion. Also, raised surfaces 15 may be optionally provided on the rim above the projections to indicate the location of the projection.

Figure 6:
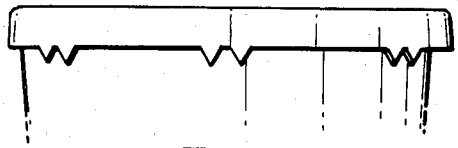
FIG. 6 is a partial elevation view of a container according to an alternative embodiment of the present invention with double projections.

Another embodiment of the present invention is shown in FIG. 6. A set of two projections spaced close together replaces the single projections. Gripping capability is increased over the single projection embodiment in part due to a gathering of bag material between the projections which helps to lock the bag in place.

Figure 7:
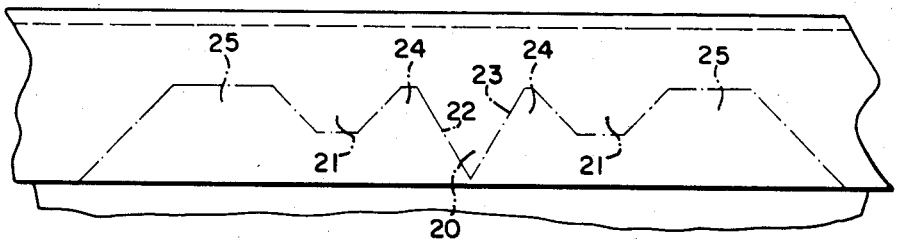
FIG. 7 is a partial elevation of a container according to an alternative embodiment of the present invention.

A preferred projection design is depicted by the broken lines in FIG. 7. The broken lines illustrate how the design would be stamped out from a traditional rim. Alternatively, of course, the design could be formed in a mold along with the rest of the container. The design consists of three projections. The center projection 20 is substantially triangular in shape to effect at least a partial perforation of the bag. The outside projections 21 are flattened or rounded so as to deform the bag material without perforating it. The preferred design works as follows. the bag is placed into the container, folded over the rim, and pulled onto the projections in the same manner as was described above. As the center projection 20 perforates the bag, some material is trapped behind and along its inside surfaces 22–23. Further perforation, as the bag is pulled inward and upward, causes the bag material to engage both of the outside projections 21. The outside projections deformably engage the bag. Continued deformation tends to gather, bunch and lock the bag material in the V grooves 24 at the base of the center triangular projection and in the grooves 25 outside of the outside projections. The locking effect creates resistance, without tearing, to lateral or downward forces acting on the bag.

The number and location of the projections may vary, although six evenly spaced projections work well. More or less may be used, however, fewer projections may not adequately support the desired weight or provide sufficient spacing to keep the bag opened wide.

Figure 8:
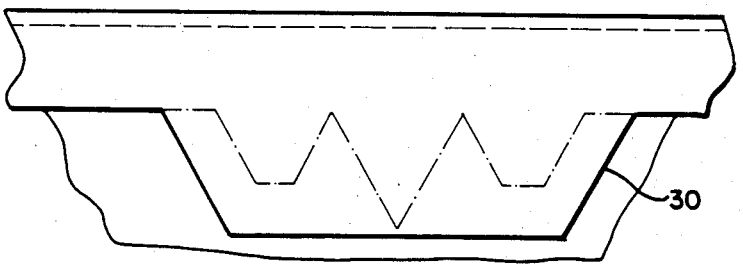
FIG. 8 is a partial elevation of a container according to still another alternative embodiment of the present invention.

Containers according to the present invention can be formed from plastics forming processes known in the art. The projections can be formed during the molding process or easily punched as a second operation, for example, at the broken lines of FIG. 7. When the projections would depend below the rim portion, they may be stamped from tabs 30 as shown in FIG. 8.

The points and/or sides of the projections can be rounded or blunted enough to avoid injury without impairing effectiveness.

Figure 9:
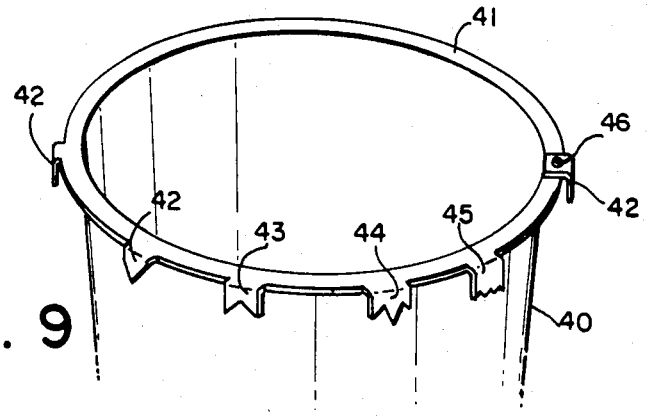
FIG. 9 is a perspective view of a container according to yet another embodiment of the present invention.

In another embodiment of the present invention, depicted in FIG. 9, a basket-type container generally designated 40 has at its top edge 41 a plurality of projections which protrude outwardly from the edge in a plane substantially parallel to the edge, and then continue downwardly for a short distance. Projections according to the present invention as described above are formed in the downwardly depending portions as shown in numbers 42–45.

Figure 10:
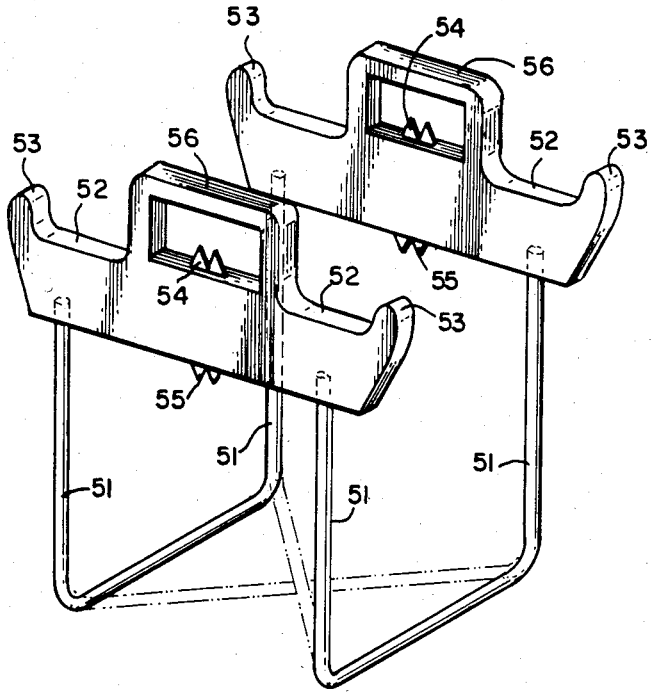
FIG. 10 is a perspective view of a bag holding structure according to still another embodiment of the present invention.

It is known that plastic bags can be supported by a structure which is not in itself a container. These structures generally comprise two parallel plates or rods 52 which are supported above the ground by vertical legs 51 as shown in FIG. 10. The fourlegs are usually provided as U-shaped structures, wherein each branch of the U forms a leg. The two U-shaped structures are connected to the plates or rods in either a parallel fashion, as shown by the solid lines in FIG. 10, or in a crisscross fashion as shown by the broken lines in FIG. 10. The U-shaped structures are also commonly rotatably connected to the plates or rods such that the plates or rods may be swung together whereby the entire structure lies flat, in substantially the same plane, for easy storage. When the structure is opened as in FIG. 10, a bag is placed between the plates or rods and the top portion of the bags, i.e., the mouth, is folded over the plates or rods so as to hold the mouth of the bag open. The plates or rods may be provided with up-turned retaining portions 52 at each end to assist in holding the bag. It has now been discovered that projections according to the present invention can greatly improve the ability of these devices to hold rubbish without pulling off of the plates or rods 52. To this end, projections 54 and 55 (shown in FIG. 10 in a double perforator embodiment) are provided on the top and bottom, respectively, of the plates or rods 52. The bag may be engaged onto the top projections 54 and then the bottom projections 55. If the device is provided with ahandle as 56 in FIG. 10, the bag may be wrapped around the handle and engaged to the projections in a variety of combinations.

Figure 11:
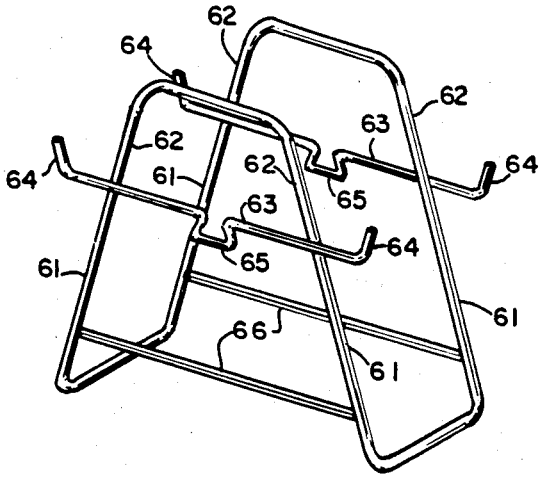
FIG. 11 is a perspective view of a bag holding structure according to an alternative embodiment of the present invention.

It is also knwon to form a trash bag holder such as that shown in FIG. 11. The holder may be fashioned from a single loop of wire or tubing into the structure shown wherein two inverted U-shaped members 61 are joined at their base. Bags with handles have commonly been secured to such a container by slipping the two handles bags, one over each inverted U-shaped member 61. It has now been found that an improved device can be formed by supplying cross bars 63 to each of the inverted U-shaped structures 61 so as to form handle portions 62. The cross bars 63 can be provided with up-turned retaining portions 64 at each end. The cross bars 63 also have downwardly depending projections 65 which are substantially in the form of an upright U which is narrower at its top than at its base. A bag is engaged by placing it between the inverted U-shaped members and folding the handles of the bag over the retaining members 65. The bag may also be engaged by folding it over the upward retaining sections 64. If desired, support structures 66 can also be provided.

Any embodiment of the invention may be practiced with containers or structures which do not have integrated projections, such as conventional rubbish containers, by the attachment of suitable projections. The attachment may be performed by detachable clips or other conventional fasteners such as rivet 46 in FIG. 9.

The present ivnention provides an apparatus and method for securing a disposable bag to a rubbish container with a minimum of effort and materials. Indeed, a rubbish container according to the present invention would need no extra materials. The bag is securely held in place by a few simple steps and can support heavy waste materials depending, of course, on the strength of the bag material.

I claim:

1. A bag holding structure, comprising:

two parallel, relatively wide cross bars having an open inverted U-shaped handle extending upwardly between upturned end retaining shoulders.

two upright U-shaped support members having ends, each end being rotatably attached to a separate one of said two cross bars; and, within said handle openings and also extending downwardly from said cross bar below said handles, projections extending upwardly from said cross bar whereby bag material can be laid over said handles, and through said handle openings to be engageable on said projections and whereby said structure can be collapsible when not in use as permitted by the rotatable securement of said support members to said cross bars.

2. A bag holding structure of claim 1 whereby said projections are V-shaped to penetrate or pierce non-handle bag edges laid over said cross bars and between said handles.

* * * * *